US009067438B2

(12) United States Patent
Soda

(10) Patent No.: US 9,067,438 B2
(45) Date of Patent: Jun. 30, 2015

(54) SHEET CONVEYING DEVICE AND IMAGE FORMING APPARATUS

(71) Applicant: KYOCERA Document Solutions Inc., Osaka-shi, Osaka (JP)

(72) Inventor: Tomohisa Soda, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/165,189

(22) Filed: Jan. 27, 2014

(65) Prior Publication Data

US 2014/0210924 A1 Jul. 31, 2014

(30) Foreign Application Priority Data

Jan. 28, 2013 (JP) ..... 2013-013270

(51) Int. Cl.
*B41J 2/01* (2006.01)
*B41J 11/00* (2006.01)

(52) U.S. Cl.
CPC ..... *B41J 11/007* (2013.01); *B41J 11/0085* (2013.01)

(58) Field of Classification Search
CPC ..... B41J 11/0085
See application file for complete search history.

(56) References Cited

U.S. PATENT DOCUMENTS 5,671,468 A * 9/1997 Yamamoto et al. ..... 399/169
2007/0109386 A1* 5/2007 Mohri et al. ..... 347/104

FOREIGN PATENT DOCUMENTS

JP H04055241 A 2/1992
JP 2003237973 A 8/2003
JP 2008230819 A 10/2008
JP 2008230820 A 10/2008
JP 2011218627 A 11/2011

* cited by examiner

*Primary Examiner* — Shelby Fidler
*Assistant Examiner* — Tracey McMillion
(74) *Attorney, Agent, or Firm* — Alleman Hall McCoy Russell & Tuttle LLP

(57) ABSTRACT

A sheet conveying device includes a conveyance belt, an air intake portion, and a charging member. The conveyance belt has a sheet placing surface on which a sheet is placed and a plurality of belt openings penetrating the sheet placing surface, and conveys the sheet placed on the sheet placing surface. The air intake portion draws air from a side of a back surface opposite to the sheet placing surface through the belt openings. The charging member has a surface which is shaped in such a manner as to contact the sheet placing surface while avoiding the belt openings and charges the sheet placing surface.

15 Claims, 6 Drawing Sheets

SHEET CONVEYING DEVICE AND IMAGE FORMING APPARATUS

INCORPORATION BY REFERENCE

This application is based upon and claims the benefit of priority from the corresponding Japanese Patent Application No. 2013-013270 filed on Jan. 28, 2013, the entire contents of which are incorporated herein by reference.

BACKGROUND

The present disclosure relates to a sheet conveying device that conveys a sheet while holding the sheet on a conveyance belt by electrostatic attraction and suction attraction, and to an image forming apparatus.

Inkjet recording apparatuses (an example of image forming apparatuses) in which ink is ejected from a recording head onto a paper sheet (sheet) to record an image are generally known. As a type of the inkjet recording apparatuses, there may be mentioned a so-called line-head type inkjet recording apparatus including recording heads for respective colors arranged along a sheet conveyance path. The inkjet recording apparatus of this type incorporates a sheet conveying device that conveys a paper sheet by means of a conveyance belt while the paper sheet is facing an ink ejection surface of each recording head, and ink is ejected from each recording head onto the paper sheet being conveyed.

In addition, a configuration is known in which a paper sheet is held on a conveyance belt by electrostatic attraction by forming an alternating charge pattern in the conveyance belt while the paper sheet is held on the conveyance belt by suction attraction by suctioning the paper sheet through a plurality of through holes formed in the conveyance belt.

SUMMARY

A sheet conveying device according to an aspect of the present disclosure includes a conveyance belt, an air intake portion, and a charging member. The conveyance belt has a sheet placing surface on which a sheet is placed and a plurality of belt openings penetrating the sheet placing surface, and conveys the sheet placed on the sheet placing surface. The air intake portion draws air from a side of a back surface opposite to the sheet placing surface through the belt openings. The charging member has a surface which is shaped in such a manner as to contact the sheet placing surface while avoiding the belt openings and charges the sheet placing surface.

An image forming apparatus according to another aspect of the present disclosure includes a sheet conveying device and an image forming portion configured to form an image on a sheet being conveyed by the sheet conveying device. The sheet conveying device includes a conveyance belt, an air intake portion, and a charging member. The conveyance belt has a sheet placing surface on which a sheet is placed and a plurality of belt openings penetrating the sheet placing surface, and conveys the sheet placed on the sheet placing surface. The air intake portion draws air from a side of a back surface opposite to the sheet placing surface through the belt openings. The charging member has a surface which is shaped in such a manner as to contact the sheet placing surface while avoiding the belt openings, and charges the sheet placing surface.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

First Embodiment

First, an inkjet recording apparatus 10 (hereinafter, abbreviated as "recording apparatus 10") according to a first embodiment of the present disclosure will be described with reference to FIG. 1.

Figure 1:
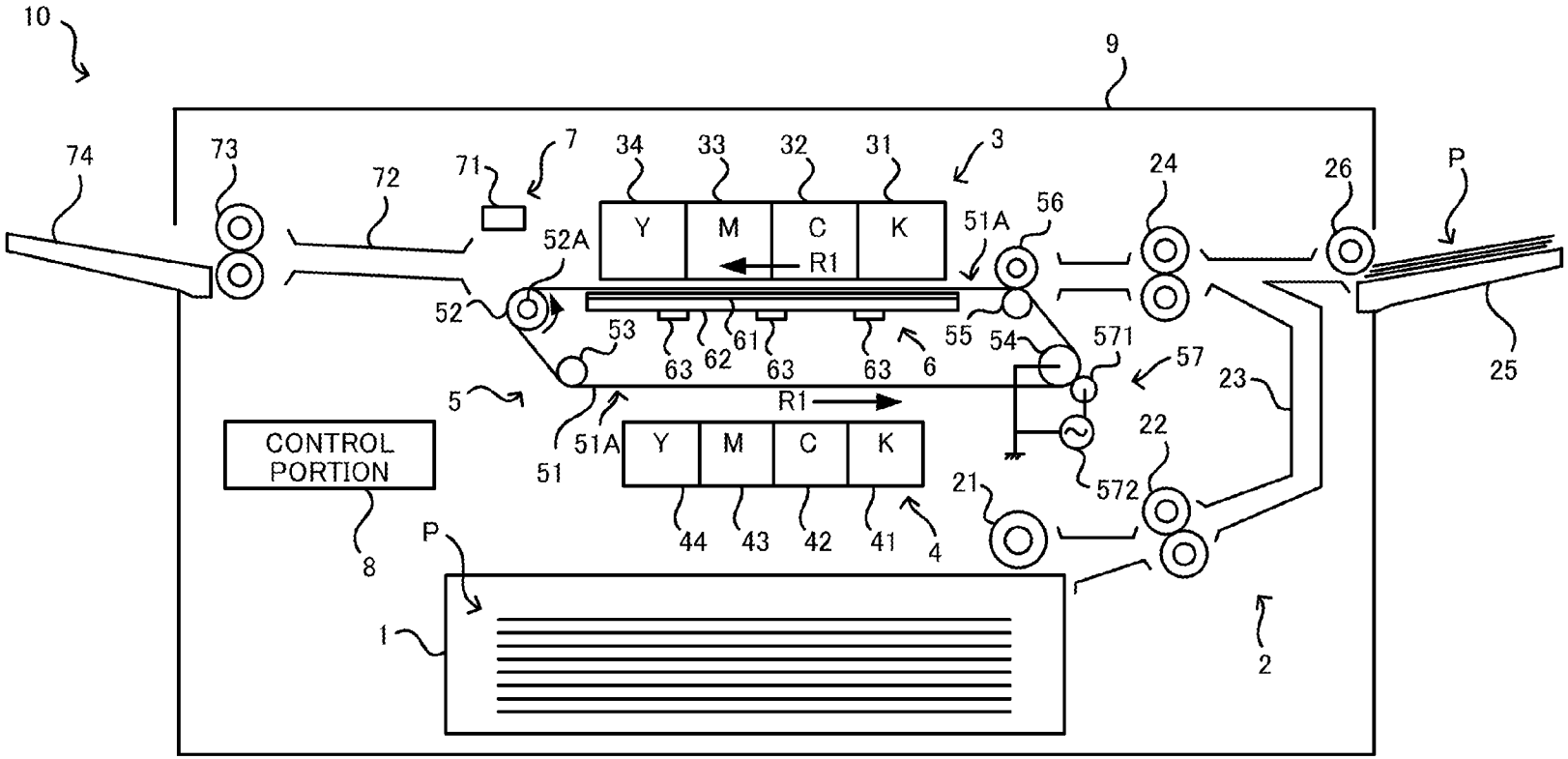
FIG. 1 is a schematic sectional view showing a schematic configuration of an inkjet recording apparatus according to an embodiment of the present disclosure.

As shown in FIG. 1, the recording apparatus 10 is an image forming apparatus including a sheet feed cassette 1, a sheet feed portion 2, an image forming portion 3, an ink tank portion 4, a sheet conveying device 5, an air intake portion 6, a sheet discharge portion 7, a control portion 8, a main body frame 9 that contains aforementioned components, and so on. The recording apparatus 10 is a printer that performs print processing for formation of an image on a paper sheet based on a printing data (image data) inputted from an information processing device such as a personal computer. The image forming apparatus according to the present disclosure can be applied not only to printers but also to copying machines, facsimile machines, multifunction peripherals, and the like. The sheet conveying device according to the present disclosure can be applied also to a sheet conveying device or the like which is included in an image reading apparatus capable of reading image data from a document, for example, and which automatically conveys the document in the image reading apparatus.

The sheet feed cassette 1 accommodates a plurality of paper sheets P. The paper sheets P are an example of sheets to be conveyed by the sheet conveying device 5, and the recording apparatus 10 forms an image on each paper sheet P. The paper sheets P are not limited to paper and may be other recording media such as OHP film.

The sheet feed portion 2 includes a pickup roller 21, conveyance rollers 22, a conveyance path 23, registration rollers 24, a manual sheet feeder 25, and a sheet feed roller 26. The pickup roller 21 picks the paper sheets P one by one from the sheet feed cassette 1. The conveyance rollers 22 and the conveyance path 23 convey each paper sheet P picked by the pickup roller 21 to the registration rollers 24. The registration rollers 24 convey each paper sheet P to the image forming portion 3 at predetermined times of conveyance (at times of start of image drawing). The manual sheet feeder 25 and the sheet feed roller 26 are used to feed the paper sheets P from outside.

The image forming portion 3 is an inkjet recording portion having a recording head 31 for a color K (black), a recording head 32 for a color C (cyan), a recording head 33 for a color M (magenta), and a recording head 34 for a color Y (yellow). Each of the recording heads 31 to 34 is disposed so as to face a sheet placing surface 51A of a conveyance belt 51 of the sheet conveying device 5. The recording heads 31 to 34 are each elongated in a width direction R2 (see FIG. 2A) perpendicular to a direction R1 of conveyance of the paper sheets P by the sheet conveying device 5 and arranged at predetermined intervals along the conveyance direction R1. Lower end portions of the recording heads 31 to 34 are each provided with an ink ejection surface having a number of nozzles (ink outlets) from which ink is ejected. In the present embodiment, a configuration with four recording heads 31 to 34 for the four colors K, C, M, and Y will be described by way of example. However, the number of the recording heads is not limited thereto, and the image forming portion 3 may have one or a plurality of recording heads.

The image forming portion 3 forms an image on each paper sheet P by ejecting the ink from the ink ejection surfaces of the recording heads 31 to 34 onto the paper sheet P placed on the sheet placing surface 51A of the conveyance belt 51 and conveyed by the sheet conveying device 5. That is, the recording apparatus 10 is a so-called line-head type inkjet recording apparatus. As an ink ejecting method of the recording heads 31 to 34, there may be employed a piezo method in which ink is ejected using a piezoelectric element or a thermal method in which ink is ejected by generating air bubbles by heating, for example.

The image forming portion 3 may be an electrophotographic image forming portion including a photosensitive drum, a charging portion, an exposure device, a developing device, a transfer roller, a fixing device, a toner container, and so on. In the electrophotographic image forming portion, the exposure device applies laser light based on image data to the photosensitive drum charged at a predetermined potential by the charging portion thereby to form an electrostatic latent image. Thereafter, the developing device develops the electrostatic latent image into a toner image using a toner supplied from the toner container. Meanwhile, each paper sheet P is conveyed by the sheet conveying device 5 along the sheet conveyance path from the sheet feed cassette 1 to the photosensitive drum and the transfer roller. The photosensitive drum and the transfer roller transfer the toner image formed on the photosensitive drum onto each paper sheet P being conveyed by the sheet conveying device 5.

The ink tank portion 4 includes an ink tank 41 for the color K (black), an ink tank 42 for the color C (cyan), an ink tank 43 for the color M (magenta), and an ink tank 44 for the color Y (yellow). The ink tanks 41 to 44 are connected to the recording heads 31 to 34 for the same colors, respectively, with ink tubes, not shown, and supply ink of the respective colors to the recording heads 31 to 34.

The sheet discharge portion 7 is provided on a downstream side of the image forming portion 3 in the conveyance direction R1 of the sheet conveying device 5. The sheet discharge portion 7 has a drying device 71, a conveyance path 72, sheet discharging rollers 73, a sheet discharge tray 74, and so on. The drying device 71 dries the ink adhering to each paper sheet P by sending air to the paper sheet P. Then, each paper sheet P dried by the drying device 71 goes through the conveyance path 72 and is discharged to the sheet discharge tray 74 by the sheet discharging rollers 73.

The control portion 8 is a computer including a CPU, a ROM, a RAM, an EEPROM, and the like. A control program for the CPU to execute various types of processing is prestored in the ROM or the EEPROM. For example, the CPU controls each component of the recording apparatus 10 based on image data inputted from outside and executes image forming processing to record an image corresponding to the image data on each paper sheet P in accordance with the control program. The RAM is used as a temporary storage for the processing to be executed by the CPU.

The sheet conveying device 5 is disposed below the recording heads 31 to 34. The sheet conveying device 5 conveys each paper sheet P fed from the sheet feed portion 2 to the sheet discharge portion 7 while keeping each paper sheet P facing the ink ejection surfaces of the recording heads 31 to 34.

Specifically, the sheet conveying device 5 includes a conveyance belt 51, a driving roller 52, driven rollers 53, 54, and 55, a pressing roller 56, a charging device 57, and so on. The gap between the conveyance belt 51 and the ink ejection surfaces of the recording heads 31 to 34 is determined so that the distance between each paper sheet P being conveyed by the conveyance belt 51 and the ink ejection surfaces of the recording heads 31 to 34 is 1 mm or more but 2 mm or less, for example.

The conveyance belt 51 is an endless belt having the sheet placing surface 51A on which each paper sheet P is placed. The conveyance belt 51 is stretched by the driving roller 52 and the driven rollers 53 to 55 at a predetermined tension. The conveyance belt 51 conveys each paper sheet P placed on the sheet placing surface 51A in the conveyance direction R1 by traveling along the conveyance direction R1 shown in FIG. 1.

The conveyance belt 51 is formed of a dielectric such as urethane rubber, PET (polyethylene terephthalate) resin, ETFE (ethylene-tetrafluoroethylene copolymer) resin, PI (polyimide) resin, or PAI (polyamide imide) resin. For example, the conveyance belt 51 is a multilayer belt including an inner layer having an electric resistance of 5 [log Ω] or more but 7 [log Ω] or less, and an outer layer having an electric resistance of 14 [log Ω] or more but 17 [log Ω] or less provided on the outer circumference of the inner layer.

The driving roller 52 is connected to a rotating shaft of a drive motor 52A. The conveyance belt 51 travels along the conveyance direction R1 as the driving roller 52 is driven by the drive motor 52A to rotate counterclockwise. Meanwhile, the driven rollers 53 to 55 rotate with the driving force generated by the driving of the driving roller 52 and transmitted via the conveyance belt 51.

The driven roller 54 is a metallic roller or the like elongated in the width direction R2 and having electrical conductivity, and is connected to the same ground as the charging device 57. Thereby, the driven roller 54 acts as an electrode in charging of the conveyance belt 51 by the charging device 57.

The pressing roller 56 is provided in a sheet feed position where each paper sheet P is fed from the sheet feed portion 2 to the sheet conveying device 5. In addition, the pressing roller 56 is disposed in a position opposed to the driven roller 55, and the conveyance belt 51 is sandwiched between the driven roller 55 and the pressing roller 56. The pressing roller 56 presses each paper sheet P fed from the sheet feed portion 2 into close contact with the conveyance belt 51.

The charging device 57 is disposed on an upstream side of the conveyance belt 51 in the conveyance direction R1 with respect to the pressing roller 56, that is, on an upstream side with respect to the sheet feed position for each paper sheet P from the sheet feed portion 2. The charging device 57 includes a power supply device 572 and a charging roller 571 that charges the sheet placing surface 51A of the conveyance belt 51. In another embodiment, the charging device 57 may include two or more charging rollers 571.

The charging roller 571 is disposed in a position opposed to the driven roller 54 via the conveyance belt 51 and driven by the traveling of the conveyance belt 51 in the conveyance direction R1 to rotate clockwise. The charging roller 571 is a roller member elongated in the width direction R2 and having electrical conductivity. The electric resistance thereof is 3 [log Ω] or more but 9 [log Ω] or less, for example. The charging roller 571 is formed from one or a mixture of a plurality of resin materials such as urethane based resin, thermoplastic elastomer, epichlorohydrin rubber, ethylene-propylene-diene copolymer rubber (EPDM), silicone based rubber, acrylonitrile-butadiene copolymer rubber, and polynorbornene rubber, for example.

When the material of the charging roller 571 is EPDM, in particular, the hardness of the charging roller 571 is increased with decrease in the electric resistance of the charging roller 571. However, the increased hardness of the charging roller 571 may make a nip between the charging roller 571 and the driven roller 54 unstable. On the other hand, a too high electric resistance may reduce the charging performance of the charging roller 571. Desirably, therefore, the electric resistance of the charging roller 571 is 3 [log Ω] or more but 9 [log Ω] or less. With an electric resistance in the range from 3 [log Ω] to 9 [log Ω], the hardness of the charging roller 571 will not be too high, and high charging performance of the charging roller 571 can be obtained.

Furthermore, when the conveyance belt 51 travels at a rate as high as approximately 800 [mm/s], the duration of contact between the charging roller 571 and each region of the sheet placing surface 51A is shortened, and thus higher charging performance is needed. Particularly desirably, therefore, the electric resistance of the charging roller 571 is 5 [log Ω] or more but 7 [log Ω] or less. The charging roller 571 having an electric resistance of 5 [log Ω] or more has high charging performance and is therefore suitable for the case where the conveyance belt 51 travels at a high rate. That is, the electric resistance of the charging roller 571 may be preliminarily determined according to the relationship between the hardness and the charging performance desired in the charging roller 571.

The charging roller 571 is electrically connected to the power supply device 572. The charging roller 571 is merely an example of a charging member that charges the sheet placing surface 51A of the conveyance belt 51, and a configuration in which a blade is used as the charging member is also possible as another embodiment.

The power supply device 572 is a constant-voltage power source that applies a predetermined constant voltage to the charging roller 571. Specifically, the power supply device 572 applies to the charging roller 571 an alternating voltage of 5 k [Vp-p] that alternates between +2.5 [kV] and −2.5 [kV] with a predetermined alternating period T1 [s]. For example, the power supply device 572 alternately switches the polarity of the constant voltage (2.5 kV) outputted from an output terminal connected to the charging roller 571 with the alternating period T1 [s]. Desirably, the alternating voltage is 3 k [Vp-p] or higher but 5 k [Vp-p] or lower. For example, the alternating period T1 is 1/100 [s] or longer but 1/10 [s] or shorter, and the frequency of the alternating voltage to be outputted from the power supply device 572 is 10 [Hz] or higher but 100 [Hz] or lower.

When the power supply device 572 applies the alternating voltage to the charging roller 571, a band-shaped pattern of charges alternating between positive and negative is formed on the sheet placing surface 51A of the conveyance belt 51. Thus, each paper sheet P fed from the sheet feed portion 2 to the conveyance belt 51 is conveyed while being held on the conveyance belt 51 by electrostatic attraction.

The power supply device 572 may be capable of changing the output voltage to apply to the charging roller 571. In this case, the control portion 8 can change the output voltage of the power supply device 572 based on any one or more of the type of the paper sheets P, the environmental temperature of the sheet conveying device 5, and the environmental humidity of the sheet conveying device 5.

Figure 2A:
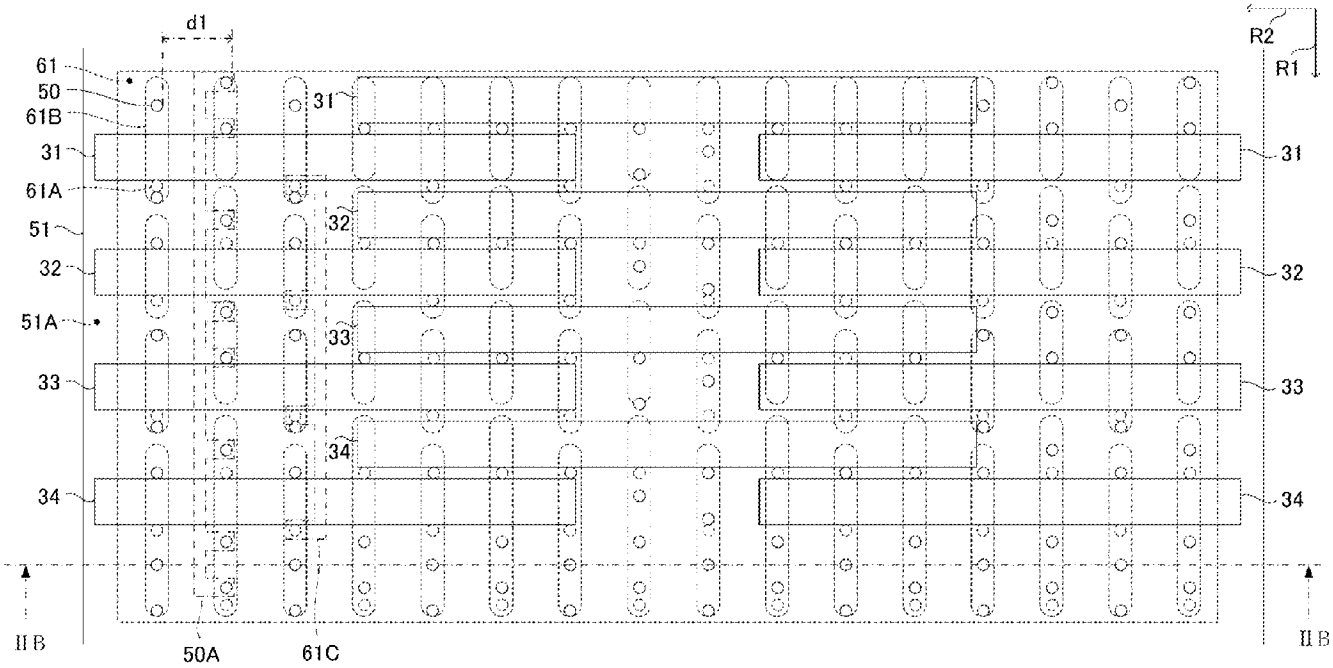
FIG. 2A and FIG. 2B are schematic views illustrating a positional relationship between an air intake portion and a conveyance belt of the inkjet recording apparatus according to an embodiment of the present disclosure.
Figure 2B:
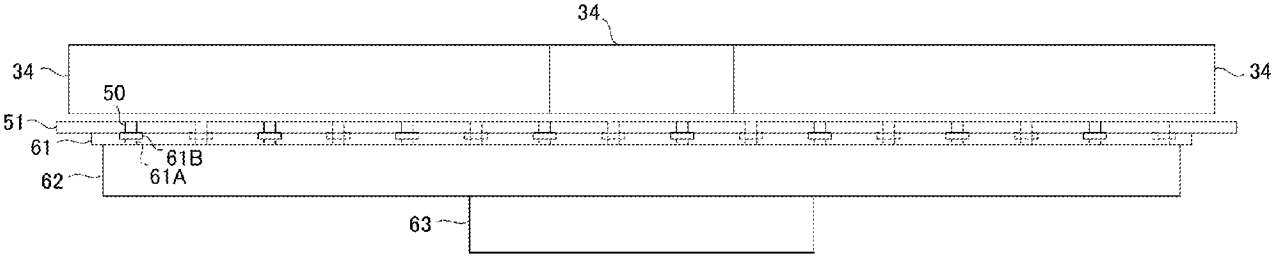

Next, the relationship between the air intake portion 6 and the conveyance belt 51 will be described with reference to FIGS. 2A and 2B. FIG. 2A is a main part schematic view showing the air intake portion 6 and the conveyance belt 51 as seen from above. FIG. 2B is a sectional view as seen from the direction of arrows IIB-IIB in FIG. 2A.

As shown in FIGS. 2A and 2B, the conveyance belt 51 has a plurality of through holes 50 (an example of the belt openings) penetrating the sheet placing surface 51A. In FIG. 2A, some of the through holes 50 that are formed in positions overlapping the recording heads 31 to 34 in the plan view are not shown. Each through hole 50 is a circular opening having a diameter of 0.5 mm or more but 4 mm or less, for example. Considering the suction force of the air intake portion 6 and the charging performance of the charging roller 571, each through hole 50 desirably has a diameter of 1.5 mm or more but 2.5 mm or less. The through holes 50 are arranged along the conveyance direction R1 at predetermined intervals d1 in the width direction R2 thereby to form, in the conveyance belt 51, opening groups 50A arranged in rows in the width direction R2 each including a plurality of through holes. The through holes 50 shown in FIG. 2A are arranged in a staggered manner but may be arranged in a square grid pattern, for example. Alternatively, the conveyance belt 51 may have belt openings having another shape such as a shape of a rectangle, an ellipsoid, or an elongated hole instead of the through holes 50.

The air intake portion 6 is disposed below the recording heads 31 to 34 and the conveyance belt 51. The air intake portion 6 includes a conveyance plate 61, a fan case 62, and air blowers 63. The air intake portion 6 draws air from the side of a back surface of the conveyance belt 51, which is opposite to the sheet placing surface 51A, through the through holes 50.

The conveyance plate 61 is a plate member disposed in a position facing the ink ejection surfaces of the recording heads 31 to 34 and facing the back surface of the conveyance belt 51. The conveyance belt 51 slides along an upper surface of the conveyance plate 61 thereby to travel while keeping a predetermined distance from the ink ejection surfaces of the recording heads 31 to 34.

The conveyance plate 61 has a plurality of through holes 61A penetrating its front and back surfaces (an example of platen openings) and a plurality of grooves 61B formed in the front surface.

The through holes 61A form, in the conveyance plate 61, opening groups 61C arranged in rows in the width direction R2 in positions corresponding to the positions of the rows of the opening groups 50A formed in the conveyance belt 51. Each through hole 61A is disposed in a position not overlapping the ink ejection surfaces of the recording heads 31 to 34 in the plan view of the recording heads 31 to 34. Alternatively, the conveyance plate 61 may have platen openings having another shape such as a shape of a rectangle, an ellipsoid, or an elongated hole instead of the through holes 61A.

Each groove 61B is a long groove formed so as to extend in a direction along the conveyance direction R1 and includes at least one through hole 61A. The depth of each groove 61B is a value corresponding to a half of the thickness of the conveyance plate 61, for example. The grooves 61B may penetrate the front and back surfaces of the conveyance plate 61. The grooves 61B may be formed continuously across the conveyance plate 61 in the conveyance direction R1.

The fan case 62 is disposed beneath the conveyance plate 61 and connected to a back surface of the conveyance plate 61. The fan case 62 is covered with the conveyance plate 61 as a top surface thereof and closed at each side surface. The bottom surface of the fan case 62 is provided with the air blowers 63 and closed except regions for air holes of the air blowers 63. That is, the fan case 62 is open only at the through holes 61A of the conveyance plate 61 and the air holes of the air blowers 63.

The air blowers 63 each have a blower fan that sends air from the fan case 62 to the outside and a drive motor that drives the blower fan. The driving of the drive motors of the air blowers 63 is controlled by the control portion 8. When the drive motors of the air blowers 63 are driven, the blower fans rotate and air is discharged from the fan case 62 to the outside. As a result, the internal pressure of the fan case 62 becomes negative. Consequently, air is drawn into the fan case 62 through each through hole 61A of the conveyance plate 61. Meanwhile, the air intake portion 6 draws air from the side of the back surface of the conveyance belt 51, which is opposite to the sheet placing surface 51A, into the fan case 62 through the through holes 50 and the through holes 61A.

Accordingly, each paper sheet P placed on the sheet placing surface 51A of the conveyance belt 51 is conveyed by the conveyance belt 51 while being held on the sheet placing surface 51A by suction attraction. The suction force of the air blowers 63 reaches not only the regions where the through holes 61A are formed but also the regions where the grooves 61B communicated with the through holes 61A are formed. The suction force therefore acts on each paper sheet P at the through holes 50 located in the regions where the grooves 61B are formed.

In the recording apparatus 10, as described above, each paper sheet P is conveyed while it is held on the conveyance belt 51 by the electrostatic attraction and the suction attraction with its high flatness being maintained. Thus, the distance between the ink ejection surfaces of the recording heads 31 to 34 and each paper sheet P being conveyed by the conveyance belt 51 is kept constant. Thereby, contact between the ink ejection surfaces and each paper sheet P is prevented, and distortion of an image to be formed on each paper sheet P is prevented.

In a configuration using both electrostatic attraction and suction attraction, by the way, a discharge may be created at the through holes 50 upon application of a voltage to the conveyance belt 51 by the charging roller 571, and therefore the charging roller 571 and the conveyance belt 51 may be deteriorated. According to the recording apparatus 10 of the present disclosure, however, the discharge that may be created at the through holes 50 can be prevented.

Figure 3A:
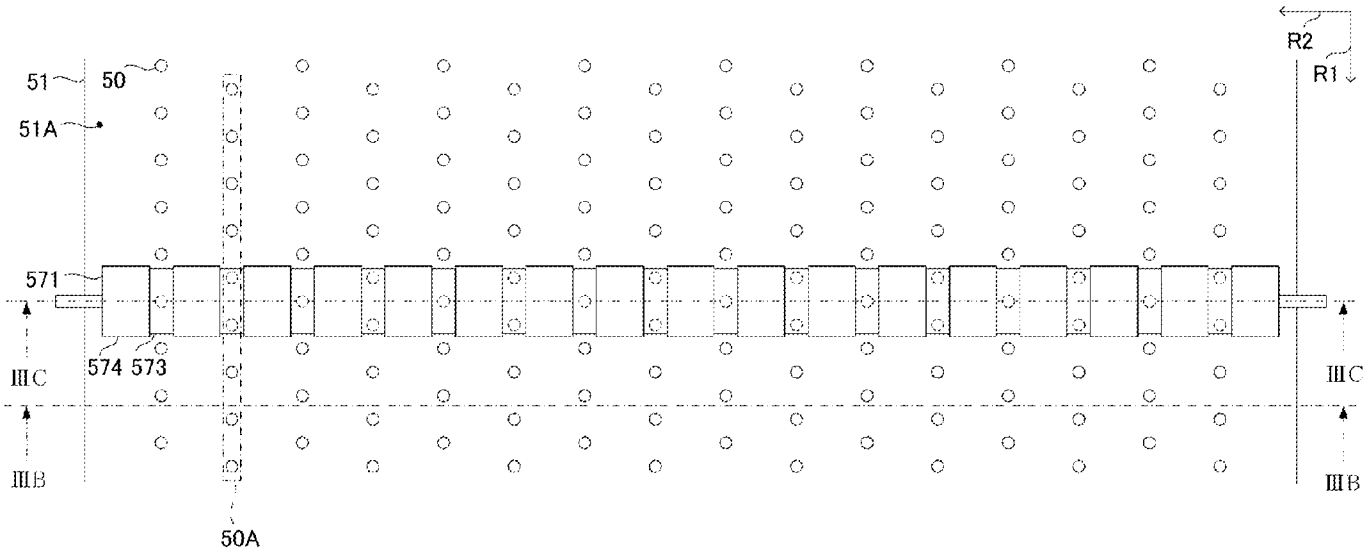
FIG. 3A to FIG. 3C are schematic views illustrating a positional relationship between the conveyance belt and a charging roller of the inkjet recording apparatus according to an embodiment of the present disclosure.
Figure 3B:
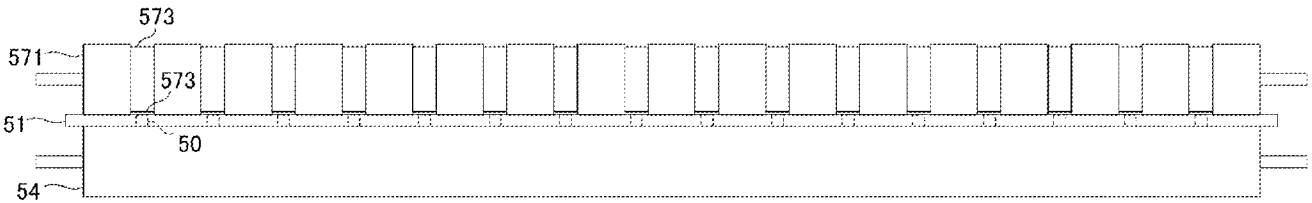
Figure 3C:
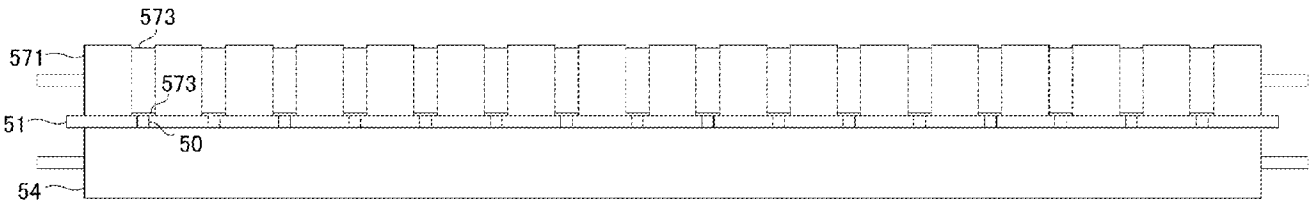

Next, the relationship between the conveyance belt 51 and the charging roller 571 will be described with reference to FIGS. 3A to 3C. FIG. 3A is a schematic view planarly showing the positional relationship between the conveyance belt 51 and the charging roller 571. FIG. 3B is a sectional view as seen from the direction of arrows IIIB-IIIB in FIG. 3A. FIG. 3C is a sectional view as seen from the direction of arrows IIIC-IIIC in FIG. 3A.

As shown in FIGS. 3A to 3C, the charging roller 571 has a shape in which a surface thereof contacts the sheet placing surface 51A while avoiding the through holes 50. Specifically, the charging roller 571 has a plurality of recesses 573 corresponding to the positions of the respective rows of the opening groups 50A formed of the through holes 50 of the conveyance belt 51. The width of each recess 573 in the width direction R2 is in such a size as to allow each through hole 50 to at least fit within the recess 573. For example, the width is 2 mm or more but 28 mm or less. Particularly desirably, the width is 5 mm or more but 7 mm or less. Each recess 573 is formed so as to continuously extend throughout the circumferential direction of the charging roller 571. The width in the width direction R2 of charging regions 574 defined as regions other than the recesses 573 in the surface of the charging roller 571 is 2 mm or more but 20 mm or less, for example. Particularly desirably, the width is 8 mm or more but 12 mm or less.

In the recording apparatus 10 configured as described above, the surface of the charging roller 571 is in contact with the conveyance belt 51 only in the charging regions 574, not in the recesses 573. Accordingly, in the configuration using both electrostatic attraction and suction attraction to attract each paper sheet P to the conveyance belt 51 and convey the same, the discharge that may be created in the through holes 50 is prevented, and deterioration of the conveyance belt 51, the charging roller 571, the driven roller 54, and the like is prevented.

The depth of the recesses 573 is preliminarily determined so that a discharge between the charging roller 571 and the driven roller 54 can be prevented. Specifically, in order to prevent the discharge between the charging roller 571 and the driven roller 54, the breakdown voltage as calculated according to the Paschen's law needs to be greater than the applied voltage, and the depth of the recesses 573 is preferably a value calculated according to the following equation (1). Here, the distance between the surface of the charging roller 571 and the surface of the driven roller 54 is an interelectrode distance d, and the maximum potential difference between the conveyance belt 51 and the charging roller 571 is v.

$$v=2.441\times10^{6}+6.73\times10^{4}\sqrt{d}+0.001/d \text{ (provided that } d>87.64\ \mu\text{m)} \quad (1)$$

Accordingly, when the maximum potential difference v is 2.5 kV and the voltage applied by the charging roller 571 is 5 k[Vp-p] as mentioned above, the interelectrode distance d can be 0.45 mm or more, according to the equation (1). For example, the depth of the recesses 573 may be a value of 0.5 mm or more but 5 mm or less. Particularly desirably, the depth is a value of 1 mm or more but 3 mm or less. Another configuration is also possible in which recesses similar to the recesses 573 of the charging roller 571 are formed in the driven roller 54.

Second Embodiment

Figure 4:
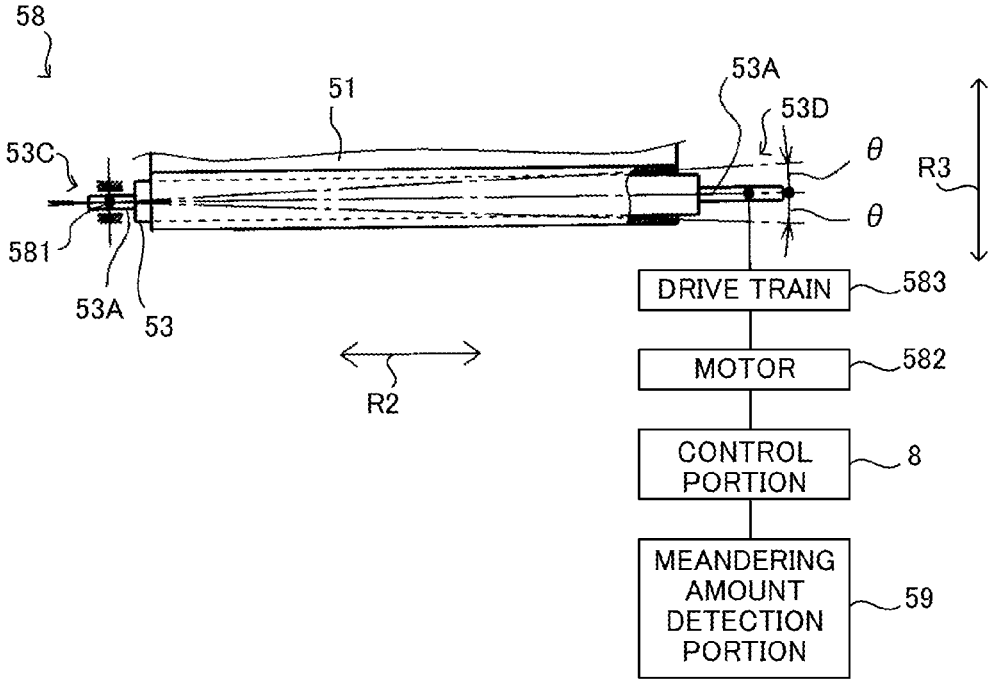
FIG. 4 is a diagram illustrating an example of a belt shifting mechanism of the inkjet recording apparatus according to an embodiment of the present disclosure.

Next, a recording apparatus 20 according to the second embodiment of the present disclosure will be described with reference to FIGS. 4 and 5. The recording apparatus 20 will be described using the same reference numerals for components identical to those of the recording apparatus 10. Specifically, the recording apparatus 20 is different from the recording apparatus 10 in that it includes a belt shifting mechanism 58 and a meandering amount detection portion 59, and the same as the recording apparatus 10 regarding the other components.

The belt shifting mechanism 58 is an example of belt shifting portion capable of shifting the conveyance belt 51 in the width direction R2 relative to the driven roller 53 by swinging the driven roller 53 based on control signals from the control portion 8. Specifically, the belt shifting mechanism 58 includes a swing supporting portion 581, a motor 582, a drive train 583, and so on as shown in FIG. 4. The swing supporting portion 581 supports a rotating shaft 53A of the driven roller 53 in such a manner that the rotating shaft 53A can be swung about a first end portion 53C in a vertical direction R3. The vertical direction R3 is a direction perpendicular to the conveyance direction R1 and the width direction R2.

The motor 582 is drive portion such as a stepping motor that rotates by a small angle according to the control signals from the control portion 8. The drive train 583 is connected to a second end portion 53D of the driven roller 53. The drive train 583 causes, with the driving force transmitted from the motor 582, the second end portion 53D of the driven roller 53 to swing about swing supporting portion 581 by ±θ [°] in the vertical direction R3. For example, the drive train 583 includes a cam (not shown) to be driven by the motor 582, a lever (not shown) to be swung by the driving of the cam, a gear train (not shown) to be driven by the motor 582, and so on.

Figure 5:
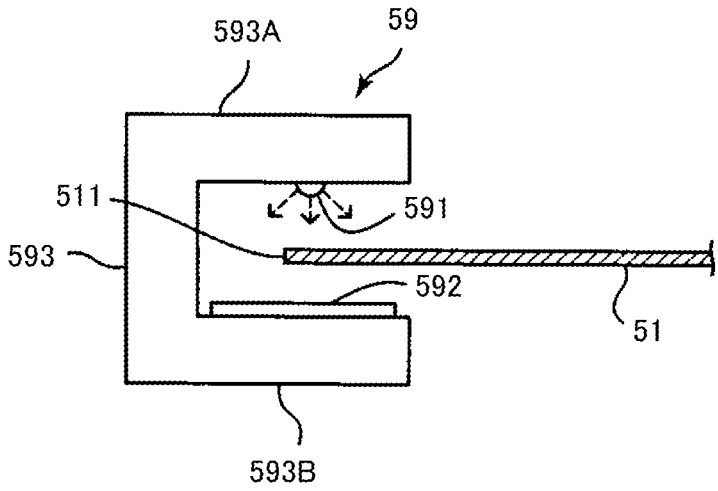
FIG. 5 is a diagram illustrating an example of a meandering amount detection portion of the inkjet recording apparatus according to an embodiment of the present disclosure.

FIG. 5 is a schematic view of the meandering amount detection portion 59. The meandering amount detection portion 59 is an example of meandering amount detection portion that detects the amount of meandering of the conveyance belt 51. The meandering amount detection portion 59 is a photo-interrupter including a light emitting portion 591, a light receiving portion 592, and a frame 593. For example, the meandering amount detection portion 59 is provided in any position between the driven roller 53 and the driven roller 54. The frame 593 has a top side 593A and an opposed bottom side 593B. The light emitting portion 591 is attached to the top side 593A, and the light receiving portion 592 is attached to the bottom side 593B. The frame 593 is supported in the sheet conveying device 5 in such a manner that one side surface 511 of the conveyance belt 51 is located between the light emitting portion 591 and the light receiving portion 592.

The light receiving portion 592 is a photodiode array having a configuration in which 20 light receiving elements (for example, photodiode) are arranged side by side on one semiconductor substrate, for example. Specifically, the light receiving elements are disposed in the light receiving portion 592 and laid side by side in the width direction R2 of the conveyance belt 51 so that the number of the light receiving elements that can receive the light emitted from the light emitting portion 591 varies according to the position of the side surface 511 of the conveyance belt 51. The light receiving portion 592 detects a light signal of a value corresponding to the number of the light receiving elements that have received the light emitted by the light emitting portion 591 as the amount of meandering of the conveyance belt 51 and outputs the signal to the control portion 8. As another example of the meandering amount detection portion 59, an arm type sensor may be used whose output voltage varies according to the swinging of an arm member urged to the side surface 511 of the conveyance belt 51 by an elastic member such as a spring.

The ROM of the control portion 8 contains a meandering correction program, and the CPU of the control portion 8 executes meandering correction processing in accordance with the meandering correction program. Specifically, the control portion 8 corrects the meandering of the conveyance belt 51 by controlling the belt shifting mechanism 58 according to the amount of meandering of the conveyance belt 51 detected by the meandering amount detection portion 59. The control portion 8 corresponds to first meandering correction portion when it executes the meandering correction processing. The meandering correction processing is executed at periodic times, at any time, or at the time of starting the recording apparatus 10, for example. The present disclosure may also be understood as a computer-readable recording medium storing therein the above-described meandering correction program or a meandering correction program to cause a computer such as the control portion 8 to execute the meandering correction processing.

Specifically, the control portion 8 causes the belt shifting mechanism 58 to swing the second end portion 53D side of the driven roller 53 downwardly when the side surface 511 of the conveyance belt 51 is protruding toward the first end portion 53C of the driven roller 53 in the width direction R2. Thereby, the conveyance belt 51 slides toward the second end portion 53D of the driven roller 53, and the meandering of the conveyance belt 51 is corrected. Likewise, the control portion 8 causes the belt shifting mechanism 58 to swing the second end portion 53D side of the driven roller 53 upwardly when the side surface 511 of the conveyance belt 51 is protruding toward the second end portion 53D of the driven roller 53 in the width direction R2. Thereby, the conveyance belt 51 slides toward the first end portion 53C of the driven roller 53, and the meandering of the conveyance belt 51 is corrected.

According to the recording apparatus 20 configured as described above, the meandering of the conveyance belt 51 is corrected by the meandering correction processing executed by the control portion 8, and the through holes 50 of the conveyance belt 51 and the recesses 573 of the charging roller 571 are kept in a constant positional relationship. Accordingly, the charging roller 571 contacts the conveyance belt 51 while avoiding the through holes 50 at the recesses 573, and the discharge that may be created in the through holes 50 is prevented.

Figure 6A:
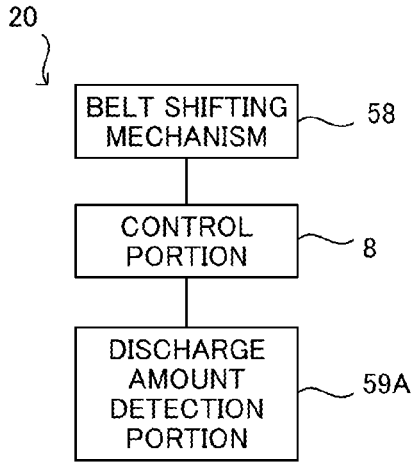
FIG. 6A to FIG. 6C are main part block diagrams showing other configurations of inkjet recording apparatuses according to embodiments of the present disclosure.

In another embodiment, as shown in FIG. 6A, the recording apparatus 20 may include, instead of the meandering amount detection portion 59, a discharge amount detection portion 59A (an example of discharge amount detection portion) configured to detect the amount of discharge upon voltage application from the charging roller 571 to the conveyance belt 51. Since the amount of discharge in the through holes 50 increases when the charging roller 571 and the conveyance belt 51 deviate from their positional relationship, the amount of discharge can be used as an index of the amount of meandering of the conveyance belt 51.

For example, the discharge amount detection portion 59A detects the current value outputted from the power supply device 572 and inputs to the control portion 8 the amount of current that exceeds a threshold preliminarily set as a current value when no discharge is created as the amount of discharge. Alternatively, the discharge amount detection portion 59A may detect the amount of current that flows through a ground connected with the driven roller 54. The control portion 8 may serve as the discharge amount detection portion 59A.

Then, the control portion 8 controls the belt shifting mechanism 58 according to the discharge amount inputted from the discharge amount detection portion 59A so that the amount of discharge is reduced, thereby correcting the meandering of the conveyance belt 51. The control portion 8 corresponds to second meandering correction portion when it executes the above-described processing. Specifically, the control portion 8 causes the belt shifting mechanism 58 to be driven so that the current value detected by the discharge amount detection portion 59A comes close to the threshold. Thus, even when the charging roller 571 and the conveyance belt 51 deviate from their positional relationship due to the meandering or the like of the conveyance belt 51, the recording apparatus 20 corrects the deviation from the positional relationship, and the amount of discharge that may be created in the through holes 50 is reduced.

Third Embodiment

Figure 6B:
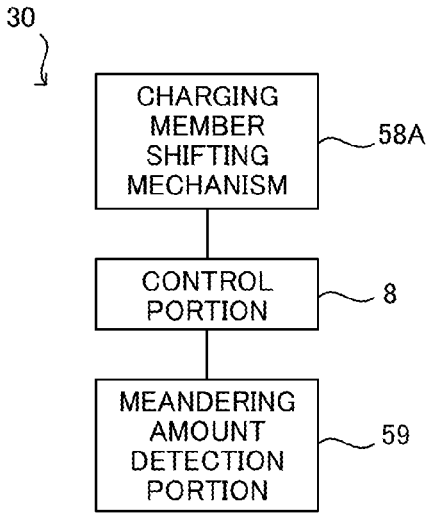

Next, a recording apparatus 30 according to the third embodiment of the present disclosure will be described. The recording apparatus 30 will be described using the same reference numerals for components identical to those of the recording apparatus 20. Specifically, as shown in FIG. 6B, the recording apparatus 30 is different from the recording apparatus 20 in that it includes a charging member shifting mechanism 58A instead of the belt shifting mechanism 58, and the same as the recording apparatus 20 regarding the other components.

The charging member shifting mechanism 58A is an example of charging member shifting portion capable of shifting the charging roller in the width direction R2 relative to the conveyance belt 51 based on control signals from the control portion 8 and correcting the positional relationship between the charging roller 571 and the conveyance belt 51. Specifically, the charging member shifting mechanism 58A supports the charging roller 571 in such a manner that the charging roller 571 can shift away from or toward the conveyance belt 51 and the charging roller 571 can shift in the width direction R2. For example, the charging member shifting mechanism 58A can be embodied by combining drive portion such as a motor or a solenoid with various drive systems to be driven by the drive portion such as a gear, a cam, a gear train, or a rack and pinion.

The ROM of the control portion 8 stores therein a position correction program, and the CPU of the control portion 8 executes position correction processing in accordance with the position correction program. Specifically, the control portion 8 corrects the positional relationship between the charging roller 571 and the conveyance belt 51 by driving the charging member shifting mechanism 58A according to the amount of meandering of the conveyance belt 51 detected by the meandering amount detection portion 59. The control portion 8 corresponds to first position correction portion when it executes the position correction processing. The present disclosure may also be understood as a computer-readable recording medium storing therein the above-described position correction program or a position correction program to cause a computer such as the control portion 8 to execute the position correction processing.

Specifically, the control portion 8 causes the charging member shifting mechanism 58A to shift the charging roller 571 toward the first end portion 53C when the side surface 511 of the conveyance belt 51 is protruding toward the first end portion 53C of the driven roller 53. Thereby, the positional relationship is corrected so that the positions of the through holes 50 of the conveyance belt 51 and the positions of the recesses 573 of the driven roller 571 coincide with each other. The control portion 8 controls the charging member shifting mechanism 58A thereby to shift the charging roller 571 away from the conveyance belt 51, and subsequently shifts the charging roller 571 in the width direction R2, and then brings the charging roller 571 into contact with the conveyance belt 51. Likewise, the control portion 8 causes the charging member shifting mechanism 58A to shift the charging roller 571 toward the second end portion 53D when the side surface 511 of the conveyance belt 51 is protruding toward the second end portion 53D of the driven roller 53. Thereby, the positional relationship is corrected so that the positions of the through holes 50 of the conveyance belt 51 and the positions of the recesses 573 of the driven roller 571 coincide with each other, and the amount of discharge that may be created in the through holes 50 is reduced.

Figure 6C:
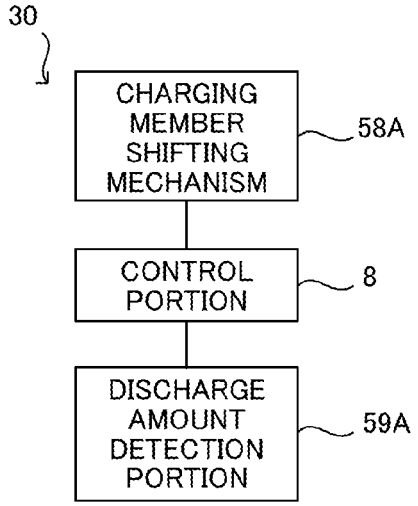

In another embodiment, as shown in FIG. 6C, the recording apparatus 30 may include the discharge amount detection portion 59A (an example of the discharge amount detection portion) instead of the meandering amount detection portion 59. In this case, the control portion 8 controls the charging member shifting mechanism 58A according to the discharge amount inputted from the discharge amount detection portion 59A so that the amount of discharge is reduced, thereby correcting the positional relationship between the conveyance belt 51 and the charging roller 571. The control portion 8 corresponds to second position correction portion when it executes the above-described processing. Specifically, the control portion 8 drives the charging member shifting mechanism 58A so that the current value detected by the discharge amount detection portion 59A comes close to the threshold. Thus, even when the charging roller 571 and the conveyance belt 51 deviate from their positional relationship due to the meandering or the like of the conveyance belt 51, the recording apparatus 30 corrects the deviation from the positional relationship, and the amount of discharge that may be created in the through holes 50 is reduced.

It should be noted that some or all of the components of the recording apparatus 10 according to the first embodiment, of the recording apparatus 20 according to the second embodiment, and of the recording apparatus 30 according to the third embodiment may be combined. For example, a configuration in which the recording apparatus 20 includes both the belt shifting mechanism 58 and the charging member shifting mechanism 58A is also possible as another embodiment. In this case, the control portion 8 can correct the deviation from the positional relationship between the charging roller 571 and the conveyance belt 51 by controlling either or both of the belt shifting mechanism 58 and the charging member shifting mechanism 58A. A configuration in which the recording apparatus 20 includes both the meandering amount detection portion 59 and the discharge amount detection portion 59A is also possible as still another embodiment. In this case, the control portion 8 can correct the deviation from the positional relationship between the charging roller 571 and the conveyance belt 51 according to either or both of the detection result from the meandering amount detection portion 59 and the detection result from the discharge amount detection portion 59A.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A sheet conveying device comprising:

a conveyance belt having a sheet placing surface on which a sheet is placed and a plurality of belt openings penetrating the sheet placing surface, the conveyance belt being configured to convey the sheet placed on the sheet placing surface;

an air intake portion configured to draw air from a side of a back surface opposite to the sheet placing surface through the belt openings; and a charging member having a surface which is shaped in such a manner as to contact the sheet placing surface while avoiding the belt openings, the charging member being configured to charge the sheet placing surface.

2. The sheet conveying device according to claim 1, further comprising a conveyance plate disposed so as to face the back surface of the conveyance belt and provided with a plurality of platen openings, wherein the air intake portion draws air from a side of a back surface of the conveyance plate through the belt openings and the platen openings.

3. The sheet conveying device according to claim 1, wherein the belt openings are arranged along a conveyance direction of the conveyance belt at predetermined intervals in a width direction perpendicular to a conveyance direction of the conveyance belt thereby to form a plurality of rows of opening groups each including a plurality of the belt openings, and the charging member is a charging roller having recesses formed extending throughout a circumferential direction of the charging roller, in such a manner as to correspond to the respective opening groups.

4. The sheet conveying device according to claim 1, further comprising:

a belt shifting portion configured to shift the conveyance belt in a width direction perpendicular to a conveyance direction of the conveyance belt;

a meandering amount detection portion configured to detect the amount of meandering of the conveyance belt; and a first meandering correction portion configured to control the belt shifting portion according to the meandering amount detected by the meandering amount detection portion and correct the meandering of the conveyance belt.

5. The sheet conveying device according to claim 1, further comprising:

a charging member shifting portion configured to shift the charging member in a width direction perpendicular to a conveyance direction of the conveyance belt;

a meandering amount detection portion configured to detect the amount of meandering of the conveyance belt; and a first position correction portion configured to control the charging member shifting portion according to the meandering amount detected by the meandering amount detection portion and correct the positional relationship between the conveyance belt and the charging member.

6. The sheet conveying device according to claim 1, further comprising:

a belt shifting portion configured to shift the conveyance belt in a width direction perpendicular to a conveyance direction of the conveyance belt;

a discharge amount detection portion configured to detect the amount of discharge upon voltage application from the charging member to the conveyance belt; and a second meandering correction portion configured to control the belt shifting portion according to the discharge amount detected by the discharge amount detection portion and correct the meandering of the conveyance belt.

7. The sheet conveying device according to claim 1, further comprising:

a charging member shifting portion configured to shift the charging member in a width direction perpendicular to a conveyance direction of the conveyance belt;

a discharge amount detection portion configured to detect the amount of discharge upon voltage application from the charging member to the conveyance belt; and a second position correction portion configured to control the charging member shifting portion according to the discharge amount detected by the discharge amount detection portion and correct the positional relationship between the conveyance belt and the charging member.

8. An image forming apparatus comprising:

a sheet conveying device including:

a conveyance belt having a sheet placing surface on which a sheet is placed and a plurality of belt openings penetrating the sheet placing surface, the conveyance belt being configured to convey the sheet placed on the sheet placing surface;

an air intake portion configured to draw air from a side of a back surface opposite to the sheet placing surface through the belt openings; and a charging member having a surface which is shaped in such a manner as to contact the sheet placing surface while avoiding the belt openings, the charging member being configured to charge the sheet placing surface; and an image forming portion configured to form an image on a sheet being conveyed by the sheet conveying device.

9. The image forming apparatus according to claim 8, wherein the image forming portion is an inkjet recording portion which has one or a plurality of recording heads arranged so as to face the sheet placing surface of the conveyance belt, and which ejects ink from the recording heads to the sheet placed on the sheet placing surface to form an image.

10. The image forming apparatus according to claim 8, further comprising a conveyance plate disposed so as to face the back surface of the conveyance belt and provided with a plurality of platen openings, wherein the air intake portion draws air from a side of a back surface of the conveyance plate through the belt openings and the platen openings.

11. The image forming apparatus according to claim 8, wherein the belt openings are arranged along a conveyance direction of the conveyance belt at predetermined intervals in a width direction perpendicular to a conveyance direction of the conveyance belt thereby to form a plurality of rows of opening groups each including a plurality of the belt openings, and the charging member is a charging roller having recesses formed extending throughout a circumferential direction of the charging roller, in such a manner as to correspond to the respective opening groups.

12. The image forming apparatus according to claim 8, further comprising:

a belt shifting portion configured to shift the conveyance belt in a width direction perpendicular to a conveyance direction of the conveyance belt;

a meandering amount detection portion configured to detect the amount of meandering of the conveyance belt; and a first meandering correction portion configured to control the belt shifting portion according to the meandering amount detected by the meandering amount detection portion and correct the meandering of the conveyance belt.

13. The image forming apparatus according to claim 8, further comprising:

a charging member shifting portion configured to shift the charging member in a width direction perpendicular to a conveyance direction of the conveyance belt;

a meandering amount detection portion configured to detect the amount of meandering of the conveyance belt; and a first position correction portion configured to control the charging member shifting portion according to the meandering amount detected by the meandering amount detection portion and correct the positional relationship between the conveyance belt and the charging member.

14. The image forming apparatus according to claim 8, further comprising:

a belt shifting portion configured to shift the conveyance belt in a width direction perpendicular to a conveyance direction of the conveyance belt;

a discharge amount detection portion configured to detect the amount of discharge upon voltage application from the charging member to the conveyance belt; and a second meandering correction portion configured to control the belt shifting portion according to the discharge amount detected by the discharge amount detection portion and correct the meandering of the conveyance belt.

15. The image forming apparatus according to claim 8, further comprising:

a charging member shifting portion configured to shift the charging member in a width direction perpendicular to a conveyance direction of the conveyance belt;

a discharge amount detection portion configured to detect the amount of discharge upon voltage application from the charging member to the conveyance belt; and a second position correction portion configured to control the charging member shifting portion according to the discharge amount detected by the discharge amount detection portion and correct the positional relationship between the conveyance belt and the charging member.

* * * * *